US007295160B2

(12) United States Patent
Purr et al.

(10) Patent No.: US 7,295,160 B2
(45) Date of Patent: Nov. 13, 2007

(54) MULTIBAND MICROWAVE ANTENNA

(75) Inventors: Thomas Purr, München (DE); Nora Brambilla, Milan (IT); Dragos-Nicolae Peligrad, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/506,379

(22) PCT Filed: Feb. 27, 2003

(86) PCT No.: PCT/IB03/00746

§ 371 (c)(1),
(2), (4) Date: Sep. 2, 2004

(87) PCT Pub. No.: WO03/077365

PCT Pub. Date: Sep. 18, 2003

(65) Prior Publication Data

US 2005/0093749 A1 May 5, 2005

(30) Foreign Application Priority Data

Mar. 8, 2002 (DE) ..... 102 10 341

(51) Int. Cl.
*H01Q 1/38* (2006.01)

(52) U.S. Cl. ..... 343/700 MS; 343/767

(58) Field of Classification Search ..... 343/700 MS, 343/702, 845, 846, 847, 848
See application file for complete search history.

(56) References Cited

U.S. PATENT DOCUMENTS 5,187,490 A * 2/1993 Ohta et al. ..... 343/770
5,264,860 A * 11/1993 Quan ..... 343/767
5,483,246 A * 1/1996 Barnett et al. ..... 343/700 MS
6,339,405 B1 1/2002 Gleener
6,462,714 B1 * 10/2002 Okabe et al. ..... 343/767
6,466,170 B2 * 10/2002 Zhou ..... 343/700 MS
6,466,176 B1 * 10/2002 Maoz et al. ..... 343/767
6,683,571 B2 * 1/2004 Ghosh et al. ..... 343/700 MS
6,762,723 B2 * 7/2004 Nallo et al. ..... 343/700 MS
6,812,891 B2 * 11/2004 Montgomery et al. ..... 343/700 MS
2006/0071857 A1 * 4/2006 Pelzer ..... 343/700 MS

FOREIGN PATENT DOCUMENTS

| | | |
|---|---|---|
| EP | 0 447 218 | 9/1991 |
| EP | 0 777 295 | 6/1997 |
| EP | 1 003 240 | 5/2000 |
| EP | 1024552 | 8/2000 |

OTHER PUBLICATIONS

F. Tefiku et al, "Design of Broad-Band & Dual-Band Antennas Comprised of Series-Fed Printed-Strip Dipole Pairs", IEEE Transactions on Antennas and Propagation, Vo. 48, No. 6.

* cited by examiner

*Primary Examiner*—Hoanganh Le
*Assistant Examiner*—Huedung Mancuso
(74) *Attorney, Agent, or Firm*—Paul Im

(57) ABSTRACT

A multiband microwave antenna (1) is described, which antenna is intended particularly for surface mounting (SMD) on a printed circuit board (PCB) and has a substrate (10) having at least a first and a second metallization structure (11, 12), wherein the first metallization structure (11) has at least a metal area (111) forming a resonator area and the second metallization structure (12) has at least a resonant printed conductor structure (121), thus enabling the antenna to combine the advantageous properties of a PIFA (planar inverted F-antenna) with those of a PWA (printed wire antenna).

8 Claims, 3 Drawing Sheets

MULTIBAND MICROWAVE ANTENNA

The invention relates to a multiband microwave antenna having a substrate and at least two metallization structures, which antenna is intended particularly intended as a surface mounted device (SMD) on a printed circuit board (PCB). The invention also relates to a printed circuit board of this kind and to a multiband telecommunications device having such a microwave antenna.

In mobile telecommunications, electromagnetic waves in the microwave range are used for transmitting information. Examples of this are the mobile telephone standards in the frequency ranges from 890 to 960 MHz (GSM900), from 1710 to 1880 MHz (GSM1800 or DCS1800) and from 1850 to 1990 MHz (GSM1900 or PCS), and also the UMTS band (1885 to 2200 MHz), the DECT standard for cordless telephones in the frequency range from 1880 to 1900 MHz, and the Bluetooth standard in the frequency range from 2400 to 2480 MHz, the purpose of which latter is to allow data to be exchanged between various electronic devices such as for example computers, consumer electronic equipment, and so on. As well as the transmission of information, there are sometimes additional functions and applications that are implemented in mobile communications devices, such as for the purpose of satellite navigation in the well-known GPS frequency range.

Modern-day telecommunications devices of this kind are intended to be capable of operating in as many as possible of the frequency ranges mentioned, and this means that corresponding multiband antennas are required which cover these frequency ranges.

To transmit or receive, the antennas have to set up electromagnetic resonances at the appropriate frequencies. To minimize the size of the antenna at a given wavelength, a dielectric having a dielectric constant $\epsilon_r>1$ is generally used as a basic building block. This causes the wavelength of the radiation to be shortened in the dielectric by a factor of $$\frac{1}{\sqrt{\varepsilon_r}}.$$

The size of an antenna designed on the basis of a dielectric of this kind will therefore become smaller by this same factor.

An antenna of this kind thus comprises a block (substrate) of dielectric material. One or more resonant metallization structures are applied to the surfaces of this substrate as dictated by the desired operating frequency band or bands. The values of the resonant frequencies depend on the dimensions and arrangement of the printed metallization structure and on the value of the dielectric constant of the substrate. The values of the individual resonant frequencies become lower as the values of the dielectric constant become higher.

Known from EP 1 024 552, for example, is a multiband antenna for communication terminal devices that is made up of a combination of a number of different types of antenna which may be singly or multiply present, which antennas are coupled together in such a way that the supply takes place at only one point. There is, however, a disadvantage in this case in that the area required for this antenna is relatively large because the individual types of antenna are arranged substantially next to one another.

It is, therefore, an object of the invention to provide an antenna of the kind detailed in the opening paragraph that, while of compact and space-saving construction, can be operated in as many frequency bands as possible of the kind mentioned above.

The intention is further to provide a multiband microwave antenna in which the resonant frequencies in the individual operating frequency bands can be tuned largely independently of one another.

The intention is also to provide a printed circuit board for a multiband microwave antenna of this kind with which it is possible to obtain particularly advantageous antenna properties with regard to the curve followed by the reflection parameters.

In accordance with claim 1, the object is achieved by a multiband microwave antenna having a substrate having at least a first and a second metallization structure, wherein the first metallization structure has at least a metal area forming a resonator area and the second metallization structure has at least a resonant printed conductor structure.

A particular advantage of achieving the object in this way is that major positive advantages of an antenna of the PIFA (planar inverted F-antenna) type can be combined with the positive advantages of an antenna of the PWA (printed wire antenna) type in this way, and a multiband antenna of small size can be implemented in which the resonant frequencies can be set largely independently of one another.

The subclaims relate to advantageous further embodiments of the invention.

The embodiment dealt with in claim 2 makes a particularly crucial contribution to compact construction and low weight.

With the embodiment dealt with in claim 4, it is possible further to increase the number of resonant frequencies, whereas with the embodiments dealt with in claims 5, 6 and 9 it is possible for largely independent tuning of the different resonant frequencies to be performed.

These and other aspects of the invention are apparent from and will be elucidated with reference to the embodiments described hereinafter.

Figure 1:
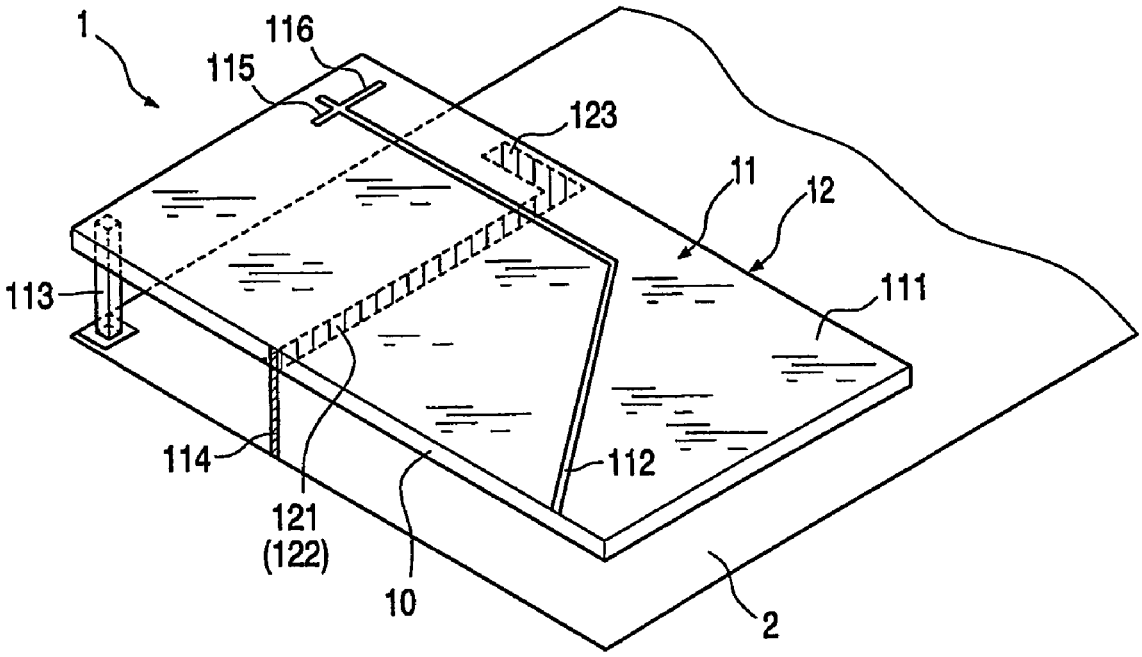
FIG. 1 is a diagrammatic view of a first antenna according to the invention.
Figure 2:
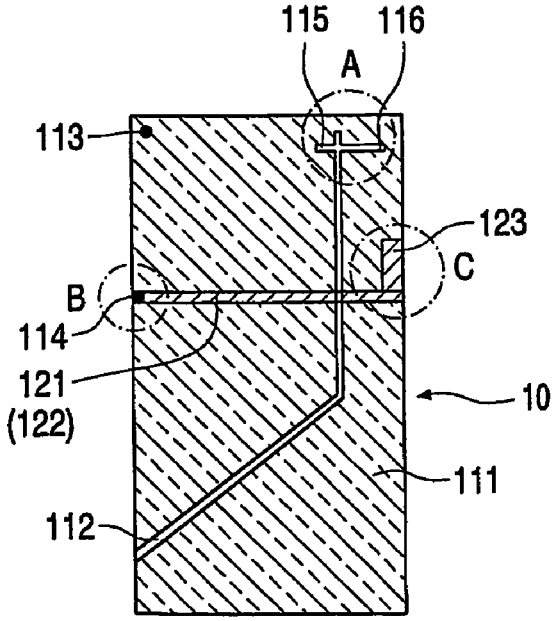
FIG. 2 is a plan view of the antenna shown in FIG. 1.

FIGS. 1 and 2 show a first embodiment of the antenna according to the invention in the form of a three-band (triple-band) antenna 1 that is arranged above a metallized base plate 2 that is at a reference potential.

The antenna comprises a substrate 10 in the form of a block of substantially parallelepiped shape whose length or width is greater than its height by a factor of from 3 to 40. The upper (large) face of the substrate 10 in the Figures will, therefore, be referred to in the description that follows as the upper main face of the substrate, the opposite face will be referred to as its lower main face and the faces that are oriented perpendicularly thereto will be referred to as its side faces.

It would, however, also be possible for other geometric shapes to be selected for the substrate 10 rather than a parallelepiped one, such for example as a cylindrical one, to which appropriate metallization structures would be applied.

The substrate 10 can be manufactured by embedding a ceramic powder in a polymer matrix and it has a dielectric constant of $\epsilon_r>1$ and/or a relative-permeability of $\mu_r>1$.

In the case of the antenna 1 shown in FIG. 1, the substrate 10 has a length of approximately 35 mm, a width of approximately 20 mm and a thickness of approximately 1 mm. The dimensions of the base plate 2 are approximately 90 mm by 35 mm.

On its two main faces, the substrate 10 carries respective first and second metallization structures 11, 12. In the case shown, the first metallization structure 11 is situated on the upper main face and comprises a metal area 111 (indicated by hatching) that covers the upper main face and forms a resonator area for a first resonant frequency (fundamental mode).

Opened up in this metal area 111 is a slot structure 112 that begins at one long side of the substrate 10 and extends to a first region A (FIG. 2) at a short side of the substrate 10. The metal area 111 is divided or segmented in this way, and as a result, as well as in the fundamental mode, parts of the area 111 can be excited to resonate at higher frequencies and at least a second resonant frequency can be obtained.

The configuration, length and width of the slot structure 112 are so selected that the segmenting of the metal area 111 produces the desired second resonant frequency. The two resonances may, for example, respectively cover the GSM900 and DCS1800 bands, the GSM900 and PCS1900 bands or the GSM900 and UMTS bands, in which case the first resonant frequency is in the GSM900 band and the second resonant frequency in the UMTS band in the embodiment shown. Other frequency bands may, however, also be covered by slight modifications to the slot structure 112.

The slot structure 112 also has the effect of lowering the fundamental mode, i.e. the first resonant frequency, and the antenna 1 can thus become effectively smaller. This may possibly entail a slightly smaller bandwidth but this can generally be accepted.

The feed to the antenna (or the coupling out of the electromagnetic energy received) takes place via a feed pin 113 that extends though a hole or cutout in the metallized base plate 2 and is conductively connected to the metal area 111 in the region of a corner of the substrate 10. The feed or coupling-out may, however, also be effected by way of capacitive coupling.

FIG. 1 also shows a ground or shorting pin 114 at one long side of the substrate 10, which pin 114 makes a connection between the metallized base plate 2 and the metal area 111 and is used to reduce the first resonant frequency.

Situated on the opposite (lower) main face of the substrate 10 is the second metallization structure 12, which comprises a resonant metal printed conductor structure 121 in the form of at least a printed conductor 122 that extends parallel to a short side of the substrate 10 and is also connected to the shorting pin 114.

This printed conductor 122 is used to excite a third resonant frequency that, in the case shown, is in the DCS1800 band. With this second metallization structure 12 too, it is possible once again for other or, if there are a plurality of printed conductors 122, a plurality of, frequency bands to be covered by making slight modifications. Allowing for the dielectric constant of the substrate 10, the length of the printed conductor 122 is selected to correspond to a quarter of the desired resonant wavelength and is thus $1_{res}=\lambda_{eff}/4=\lambda_0/(4\sqrt{\epsilon_{effrms}})$, where $\epsilon_{eff}$ is the dielectric constant of the substrate of which the mean has found in a suitable way.

The printed conductor structure 121 may also comprise a plurality of individual printed conductors 122, which are connected to the metallized base plate 2 by one or more shorting pins 114. The length of the printed conductors 122 and the position of the shorting pins 114 are selected in such a way that resonances are in each case obtained at approximately a quarter of the desired resonant wavelength. In this way and by positioning the printed conductors 122 in a suitable manner, it is possible to ensure that the resonant frequencies of the first metallization structure 11 are not substantially affected.

FIG. 2 shows the antenna of FIG. 1 viewed from above, with the metallized base plate 2 being omitted. In this view, the metal area 111 and the slot structure 112 that segments it can again be seen on the upper main face. Also shown in the drawing is the metal printed conductor structure 121 situated on the lower main face. Finally, this Figure also shows the positions of the feed pin 113 and the shorting pin 114.

A particular advantage of the antennas according to the invention is that the resonant frequencies can be tuned selectively and, over wide ranges, largely independently of one another.

In the case of the antenna shown in FIGS. 1 and 2, tuning slots 115, 116 are formed for this purpose in the metal area 111 in the region A at the end of the slot structure 112, which tuning slots 115, 116 extend substantially perpendicularly to and from both sides of the slot structure 112. By making these tuning slots 115, 116 of the appropriate length, the first resonant frequency is tuned, for which purpose the slots may, for example, be lengthened by means of a laser beam as part of the industrial production process when the antenna 1 is in the fitted state.

The value of the second, higher resonant frequency generated by the slot structure 112 can be set largely by altering the position of the shorting pin 114 relative to the feed pin 113 in the region B shown in FIG. 2.

To allow the third resonant frequency to be set, the printed conductor 122 has at its end, in the region C shown in FIG. 2, a tuning slot 123, which extends perpendicularly to the printed conductor 122 and can be shortened for this purpose by means of, for example, a laser beam.

Figure 3:
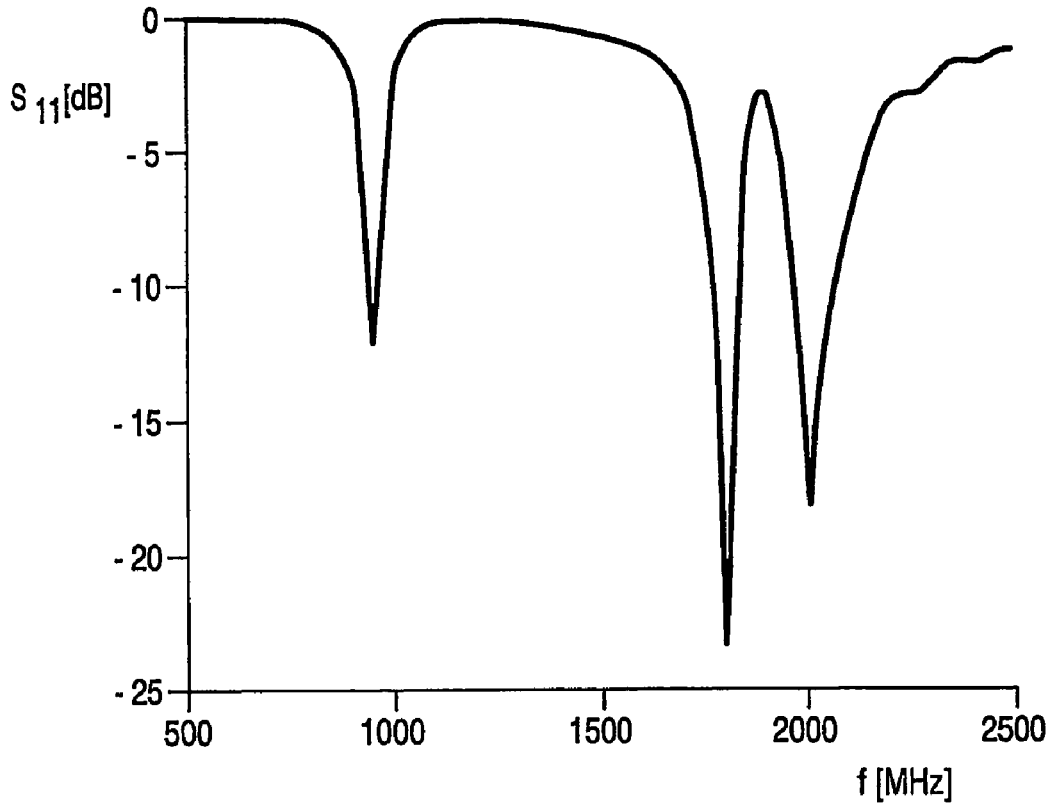
FIG. 3 is a graph showing the curve for the $S_{11}$ reflection parameters of the antenna of FIG. 1 as a function of frequency.

FIG. 3 shows the curve, as determined by experiment, that is followed by the $S_{11}$ reflection parameter as a function of frequency, for the antenna shown in FIGS. 1 and 2. The three resonant frequencies, which are situated at approximately 930 MHz, 1800 MHz and 2100 MHz, can clearly be seen.

Figure 4:
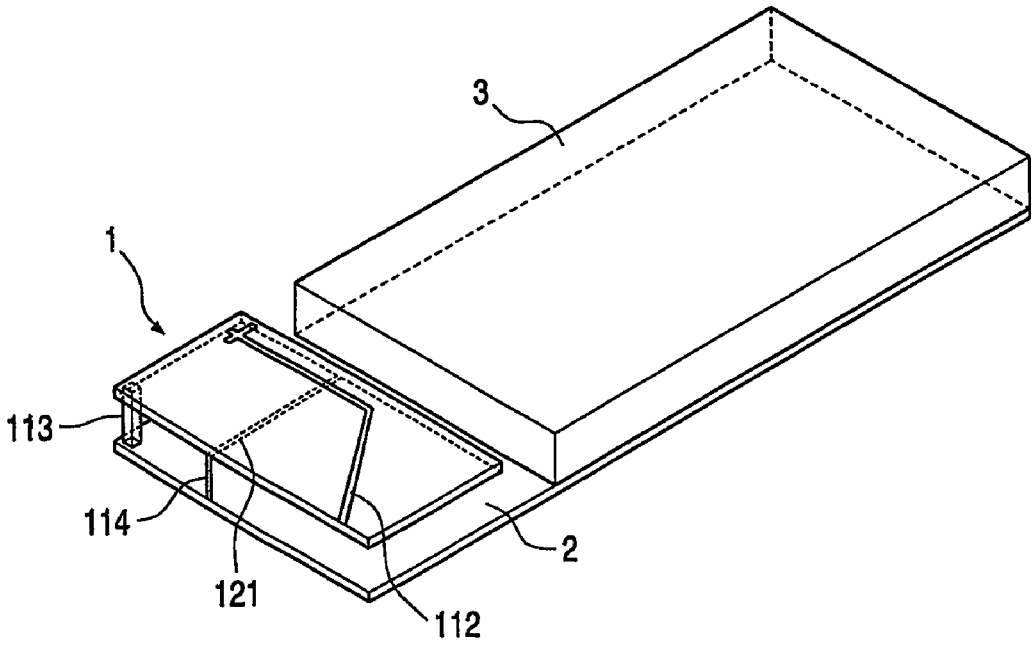
FIG. 4 shows the antenna of FIG. 1 in its typical surroundings in a mobile telephone.

FIG. 4 shows the antenna in its typical surroundings next to a battery 3 in a mobile telephone. What this means is that the electrical near-field environment of the antenna (ignoring the influence of the user) is determined by the printed circuit board (metallized base plate 2) of the mobile telephone, which is assumed to be fully metallized, and by the battery 3, which is metal too.

Figure 5:
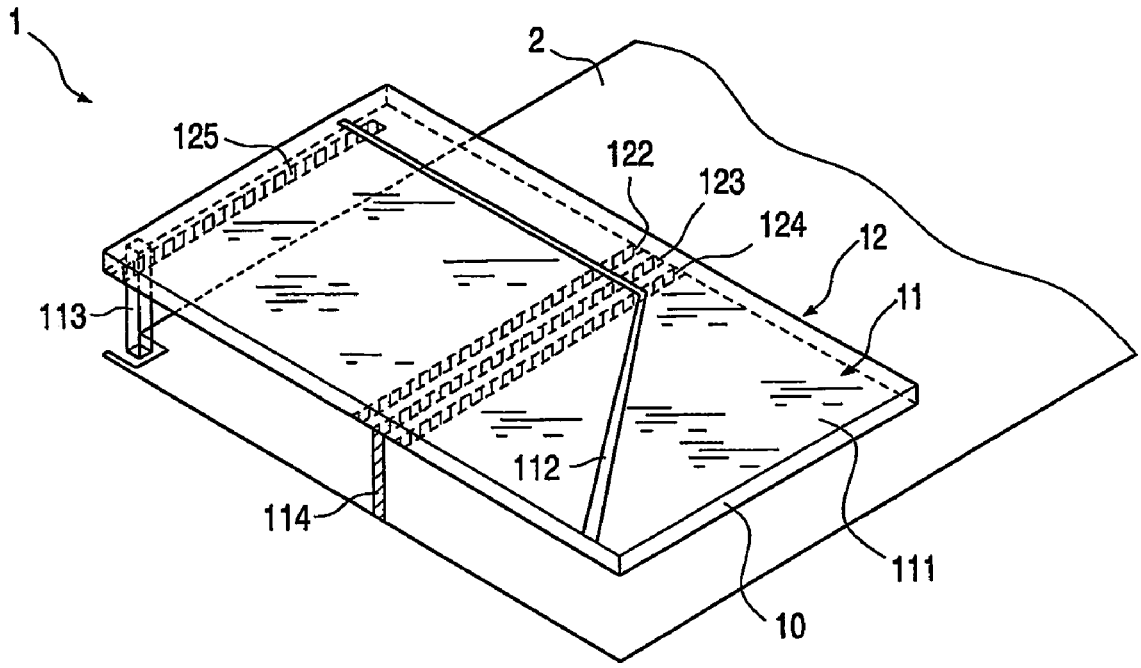
FIG. 5 shows a second antenna according to the invention.

FIG. 5 shows a second embodiment of the invention in the form of a four-band antenna 1, which is once again arranged above a metallized base plate 2. The dimensions of the antenna 1, or rather of the substrate 10, and the area of the base plate 2 are the same as in the case of the first embodiment.

The antenna once again has, on its main face that is the upper face in the drawing, the first metallization structure 11 having the metal area 111 (indicated by hatching), which area 111 forms a resonator area in the manner described above, is segmented by the slot structure 112, is connected to the feed pin 113 and is used to generate a first and a second resonant frequency.

Situated on the lower main face is the second metallization structure 12 in the form of the metal printed conductor structure 121 but, in contrast to the first embodiment, in this case it comprises three printed conductors 122, 123, 124 arranged in a comb-like form that are electrically connected to the metallized base plate 2 via the shorting pin 114. The printed conductor structure 121 further comprises an individual printed conductor 125 that, in the region of a short side of the substrate 10, runs parallel to the printed conductors 122, 123, 124 arranged in a comb-like form, and that is connected to the feed pin 113. As a function of their length, the three printed conductors 122, 123, 124 generate a third resonant frequency that is situated in, for example, the range covered by either the DCS1800, PCS1900 or UMTS band. Finally, the individual printed conductor 125 generates a fourth resonant frequency, which may, for example, be situated at 2.4 GHz in the frequency range defined by the Bluetooth band.

Figure 6:
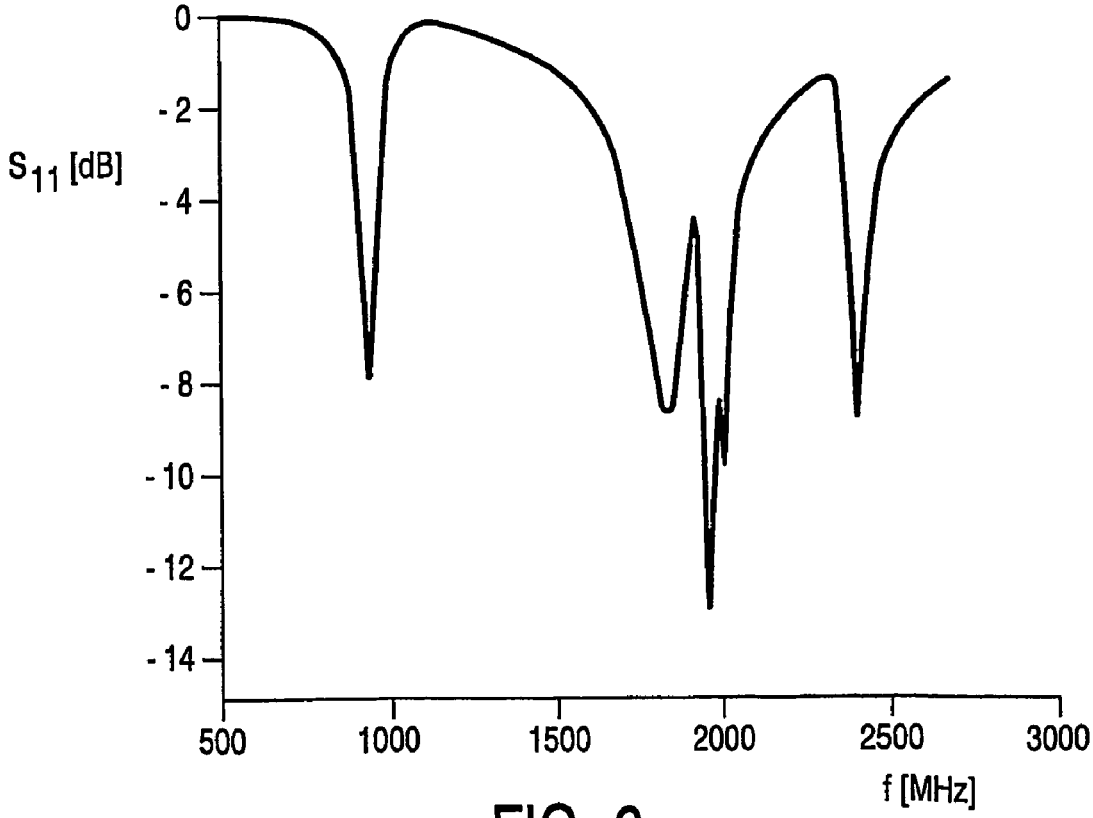
FIG. 6 is a graph showing the curve for the $S_{11}$ reflection parameters of the antenna shown in FIG. 2 as a function of frequency.

FIG. 6 shows a numerically simulated curve for the $S_{11}$ reflection parameter as a function of frequency for this antenna. The four resonant frequencies, which are situated at approximately 900 MHz, 1800 MHz, 2000 MHz and 2400 MHz, can clearly be seen.

By adding further slot structures in the first metallization structure 11 and/or further printed conductors to the second metallization structure 12, further frequency bands can be covered with the antennas according to the invention and corresponding multiband antennas can be produced.

Hence, with the antennas according to the invention, it is possible to combine the advantages of a known PIFA (planar inverted F-antenna), which are obtained essentially from the first metallization structure 11, with the advantages of a known PWA (printed wire antenna), which are obtained essentially from the second metallization structure 12.

The invention claimed is:

1. A multiband microwave antenna having a substrate (10) having at least a first and a second metallization structure (11, 12), wherein the first metallization structure (11) has at least a metal area (111) forming a resonator area and the second metallization structure (12) has at least a resonant printed conductor structure (121), wherein the metal area (111) of the first metallization structure (11) includes at least one slot structure (112) that segments said metal area (111), said slot structure including tuning slots (115, 116), each positioned at a same end of said slot structure and extending in opposite directions from said slot structure.

2. A multiband microwave antenna as claimed in claim 1, in which the metallization structures (11, 12) are applied to mutually opposed main faces of a substantially parallelepiped substrate (10).

3. A multiband microwave antenna as claimed in claim 1, in which the substrate (10) is arranged above a metallized base plate (2) that is at a reference potential.

4. A multiband microwave antenna as claimed in claim 1, in which the at least a printed conductor structure (121) is provided with a tuning slot (123).

5. A multiband microwave antenna as claimed in claim 1, which is fed via a feed pin (113) that is connected to the first and/or to the second metallization structure (11, 12).

6. A multiband microwave antenna as claimed in claim 1, in which the first and/or the second metallization structure (11, 12) is connected to a shorting pin (114) fastened to the metallized base plate (2).

7. A printed circuit board, particularly for a mobile telecommunications device, having a multiband microwave antenna (1) having a substrate (10) having at least a first and a second metallization structure (11, 12), wherein the first metallization structure (11) has at least a metal area (111) forming a resonator area and the second metallization structure (12) has at least a resonant printed conductor structure (121), wherein the metal area (111) of the first metallization structure (11) includes at least one slot structure (112) that segments said metal area (111), said slot structure including tuning slots (115, 116), positioned at a same end of said slot structure and extending in opposite directions from said slot structure.

8. A telecommunications device having a multiband microwave antenna (1) having a substrate (10) having at least a first and a second metallization structure (11, 12), wherein the first metallization structure (11) has at least a metal area (111) forming a resonator area and the second metallization structure (12) has at least a resonant printed conductor structure (121), wherein in the metal area (111) of the first metallization structure (11) includes at least one slot structure (112) that segments said metal area (111), said slot structure including tuning slots (115, 116), each positioned at a same end of said slot structure and extending in opposite directions from said slot structure.

* * * * *